US006481408B2

(12) United States Patent
Tsutsumikoshi

(10) Patent No.: US 6,481,408 B2
(45) Date of Patent: Nov. 19, 2002

(54) ENGINE UNIT OF MOTORCYCLE

(75) Inventor: Shinobu Tsutsumikoshi, Hamamatsu (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/915,336

(22) Filed: Jul. 27, 2001

(65) Prior Publication Data

US 2002/0017266 A1 Feb. 14, 2002

(30) Foreign Application Priority Data

Jul. 31, 2000 (JP) ..... 2000-231691

(51) Int. Cl.[7] ..... F02F 7/00

(52) U.S. Cl. ..... 123/195 R; 123/192.2; 180/219

(58) Field of Search ..... 123/195 H, 192.2, 123/195 R, 195 HC; 180/218, 219

(56) References Cited

U.S. PATENT DOCUMENTS 6,341,659 B1 * 1/2002 Ibukuro ..... 180/219

* cited by examiner

*Primary Examiner*—Tony M. Argenbright
*Assistant Examiner*—Katrina B. Harris
(74) *Attorney, Agent, or Firm*—Oblon, Spivak, McClelland, Maier & Neustadt, P.C.

(57) ABSTRACT

An engine unit of a motorcycle generally include a cylinder head, a cylinder block formed with a cylinder bore therein, a crankcase and a rear case sequentially assembled in this order from a front side of a motorcycle body. A crankshaft is pivoted to a mating face between the cylinder block and the crankcase, a counter shaft which is rotated with the crankshaft in an interlocking manner is pivoted to a mating face between the crankcase and the rear case. These two mating faces lie in planes parallel to each other so as to be substantially perpendicular to a center axis of the cylinder bore of the cylinder block.

9 Claims, 7 Drawing Sheets

ENGINE UNIT OF MOTORCYCLE

BACKGROUND OF THE INVENTION

The present invention relates to an engine unit mounted on a motorcycle such as a scooter type vehicle or the like.

Generally, in an engine unit of a scooter type vehicle, a belt type transmission is integrally connected to a rear portion of an engine and a rear wheel is directly pivoted to a most rear portion of the transmission. A front portion of the engine unit is pivoted to a body frame of a motorcycle body and a rear portion thereof is suspended to the body frame by a shock absorber. Thus, whole of the engine unit is swung vertically together with the rear wheel so as to act as a part of a swing arm of the rear wheel.

According to the structure mentioned above, it is advantageous to increase a capacity of an article accommodation space placed above the engine unit and improve a riding quality by making hard an engine vibration to be transmitted to the frame side. However, on the contrary, since a weight of the whole of the engine unit becomes heavy in the case that a displacement (exhaust amount) of the engine is increased, a divided load of the rear wheel is increased, a load distribution between front and rear wheels is made improper and a support rigidity becomes low level, so that it is disadvantageous that a steering performance and a running stability are deteriorated.

Then, as shown in Japanese Patent Laid-Open Publication Nos. HEI 10-324287 and 11-129969, there have been developed a scooter type vehicle in which an engine and a transmission are fixed to a body frame side and only a shaft drive apparatus extending rearward from the transmission is made vertically swingable to drive the rear wheel. Accordingly, it is possible to mount an engine having a heavy load to a front side of the body frame as like as in the normal type motorcycle so as to make a load distribution between the front and rear wheels proper.

In the engine unit described in Japanese Patent Laid-Open Publication Nos. HEI 10-324287 and 11-129969, an engine case (a crankcase), to which the crankshaft and the counter shaft rotating with the crankshaft in an interlocking manner are pivoted, is separated in a direction of a vehicle width. Further, there is another engine unit of a motorcycle in which the engine case is separated in a vertical direction.

However, in the structure in which the engine case is separated in the direction of the vehicle width or the vertical direction, since face directions of respective mating faces (the separated surfaces) are different from a face direction of a mating face between the cylinder assembly and the engine case, it is necessary to machine a plurality of mating faces having different face directions in the engine case, so that as well as a lot of labor and time is required for machine working, it is very disadvantageous in view of accuracy.

Further, since a fastening member for assembling the engine case itself and a fastening member for fastening the cylinder assembly to the engine case are independently required, many numbers of the fastening members are required, and it is hence unavoidable that the number of the parts and much labor and time for assembling working are increased, thus increasing a manufacturing cost of the engine unit in addition to the hard machining of the engine case.

SUMMARY OF THE INVENTION

An object of the present invention is to substantially eliminate defects or disadvantages encountered in the prior art mentioned above and to provide an engine unit of a motorcycle capable of reducing a manufacturing cost of the engine unit, improving an assembling property and improving assembling accuracy of the engine unit by easily machining a cylinder block, a crankcase and the like and reducing a number of the parts, and improving a support rigidity of the crankshaft and a counter shaft pivoted in the engine unit.

Another object of the present invention is to provide an engine unit of a motorcycle capable of improving a layout of an exhaust muffler by making large a ground clearance below a cylinder head, improving an oil returning property of the cylinder head, increasing an oil storage amount and achieving easy attaching and detaching of an oil filter.

These and other objects can be achieved according to the present invention by providing an engine unit of a motorcycle comprising a cylinder head, a cylinder block formed with a cylinder bore therein, a crankcase and a rear case, which are sequentially assembled in this order from a front side of a motorcycle body, wherein a crankshaft is pivoted to a mating face between the cylinder block and the crankcase, a counter shaft which is rotated with the crankshaft in an interlocking manner is pivoted to a mating face between the crankcase and the rear case and these two mating faces lie in planes parallel to each other so as to be substantially perpendicular to a center axis of the cylinder bore of the cylinder block.

In a preferred embodiment, the cylinder block is fastened by a fastening member inserted from a side of the rear case so as to extend through the crankcase to thereby fasten the rear case and the crankcase together to the cylinder block in a clamped manner. The fastening member has a center axis parallel to the center axis of the cylinder bore. The fastening member includes a plurality of through bolts which are arranged in a vicinity of the crankshaft and the counter shaft so as to clamp the crankshaft and the counter shaft therebetween.

The cylinder head is fastened and fixed to the cylinder block by a plurality of long fixing bolts and a single short fixing bolt, and the crankcase and the rear case are fastened and fixed to the cylinder block by the four though bolts and a plurality of fixing bolts. All of these fixing bolts have center axes substantially parallel to the center axis of the cylinder bore.

The center axis of the cylinder bore is arranged so as to extend substantially along a longitudinal direction of the motorcycle body in a side view thereof and at least one of the cylinder block, the crankcase and the rear case has a lower portion lowered below a lower surface of the cylinder head so as to provide an inner portion of the lowered portion as an oil storage portion. The center axis of the cylinder bore has an front upward inclination in a side view of the motorcycle body and the oil storage portion has a bottom formed to be flat substantially in parallel to a road surface. The oil storage portion has a front portion to which an oil filter is placed below the cylinder bore in a side view of the motorcycle body and above the bottom of the oil storage portion.

According to the characters and structures of the engine unit of the motorcycle of the present invention mentioned above, it is easy to execute a flattening (plane) machining or working of the mating faces of the crankcase and the cylinder block, and the accuracy in parallelism between the respective mating faces can be improved. Further, in the case of making rectangular (right angle) a relative angle between the face directions of the respective mating faces and the center axis of the cylinder bore, since it is possible to continuously execute a flattening machining of the mating face of the cylinder block and a drilling working of the cylinder bore, it becomes further easy to work and it is hence possible to significantly increase a rectangular (vertical) accuracy of the center axis of the cylinder bore with respect to the mating face. Accordingly, a manufacturing cost of the engine unit can be reduced and the working performance can be also improved.

Furthermore, in accordance with the structure of the preferred embodiment mentioned above, the following advantages functions and/or effects will be attained.

Since the rear case and the crankcase can be fastened to the cylinder block by the common fastening member, it is possible to reduce the number of the fastening members, resulting in the manufacturing cost reducing and improvement of the assembling property. Further, since the long fastening member extending through the entire crankcase is utilized to be fastened to the cylinder block, it is possible to significantly increase a mounting rigidity of the crankcase with respect to the cylinder block.

Since it is possible to work an inserting hole of the fastening member at the same time of drilling working of the cylinder bore in the cylinder block, the assembling working can be significantly performed.

Furthermore, according to the location of a plurality of fastening members, i.e. through bolts, the support rigidity of the crankshaft and the counter shaft can be improved Still furthermore, it is possible to omit an oil pan which is conventionally provided as an independent member below the crankcase or the like, whereby the number of the parts can be reduced, and since it becomes unnecessary to form an oil pan mating face in the crankcase, the assembling working can be easily done.

Still furthermore, the ground clearance below the cylinder head becomes large, a layout of the exhaust muffler can be improved, so that the oil supplied within the cylinder head can be easily returned to the oil storage portion, and it is also possible to increase the oil storage amount.

Still furthermore, it is possible to improve an attaching and detaching property of the oil filter.

The nature and further characteristic features of the present invention will be made more clear from the following descriptions made with reference to the accompanying drawings.

DESCRIPTION OF THE PREFERRED EMBODIMENT

An embodiment of the present invention will be described hereunder with reference to the accompanying drawings.

Figure 1:
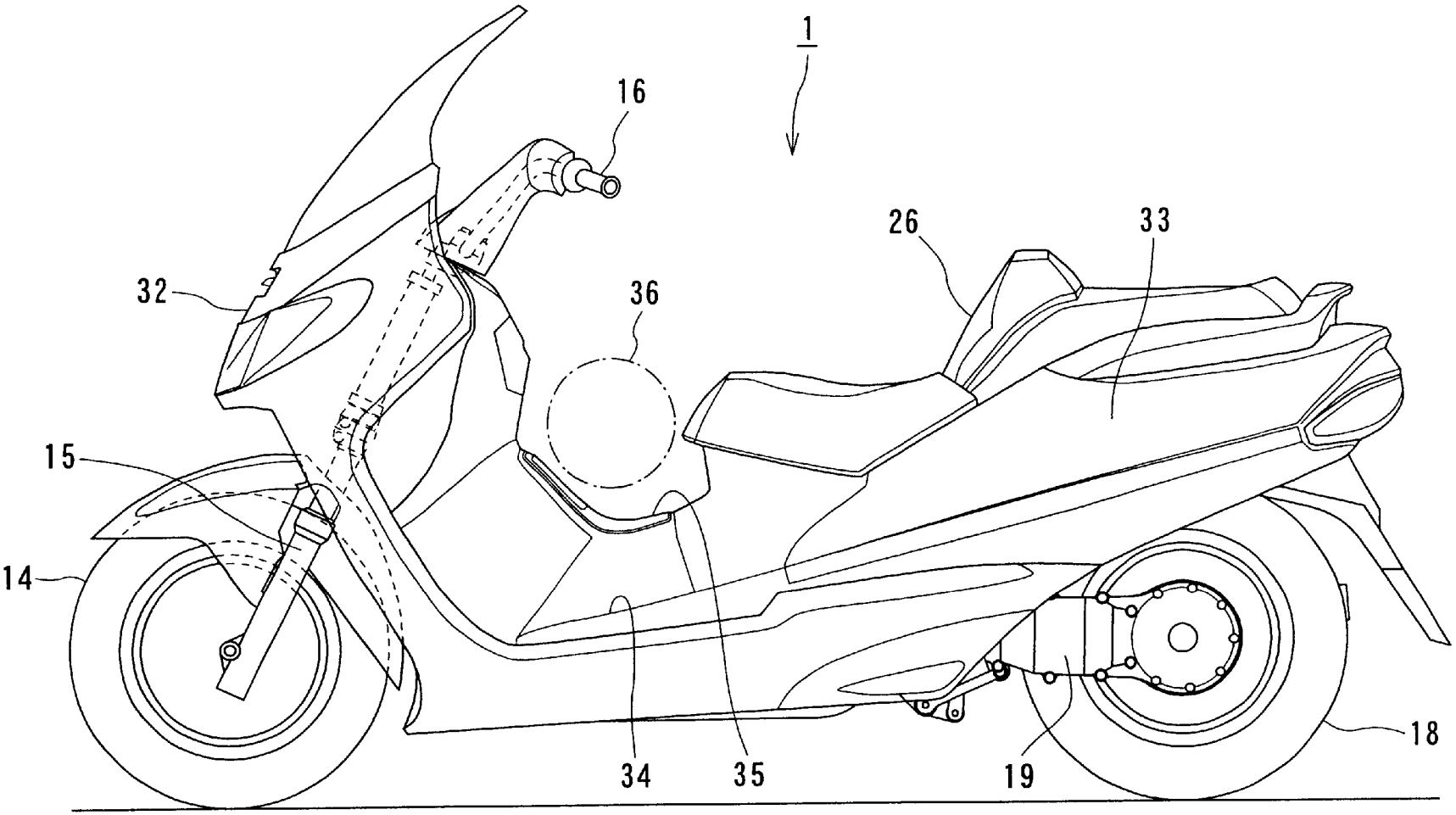
FIG. 1 is a left side view showing an embodiment of a scooter type motorcycle on which a power unit including an engine unit of the present invention is mounted.

First, it is to be noted that the terms "upper", "lower", "vertical", "horizontal", "right", "left" and the like used herein are ones in the illustrated states or in a state of a motorcycle standing such as shown in FIG. 1.

Figure 2:
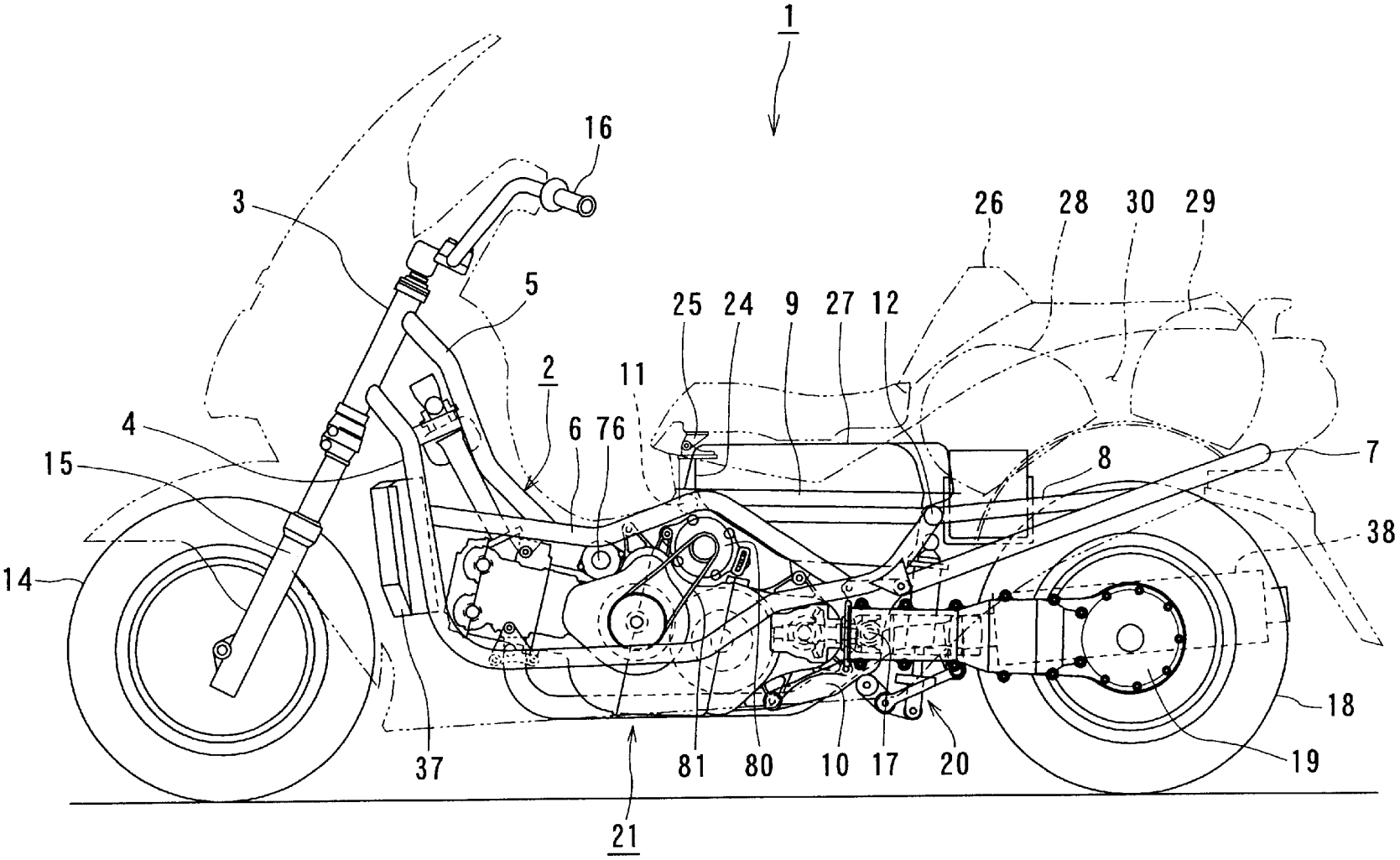
FIG. 2 is a left side perspective view showing an internal structure of the motorcycle.
Figure 3:
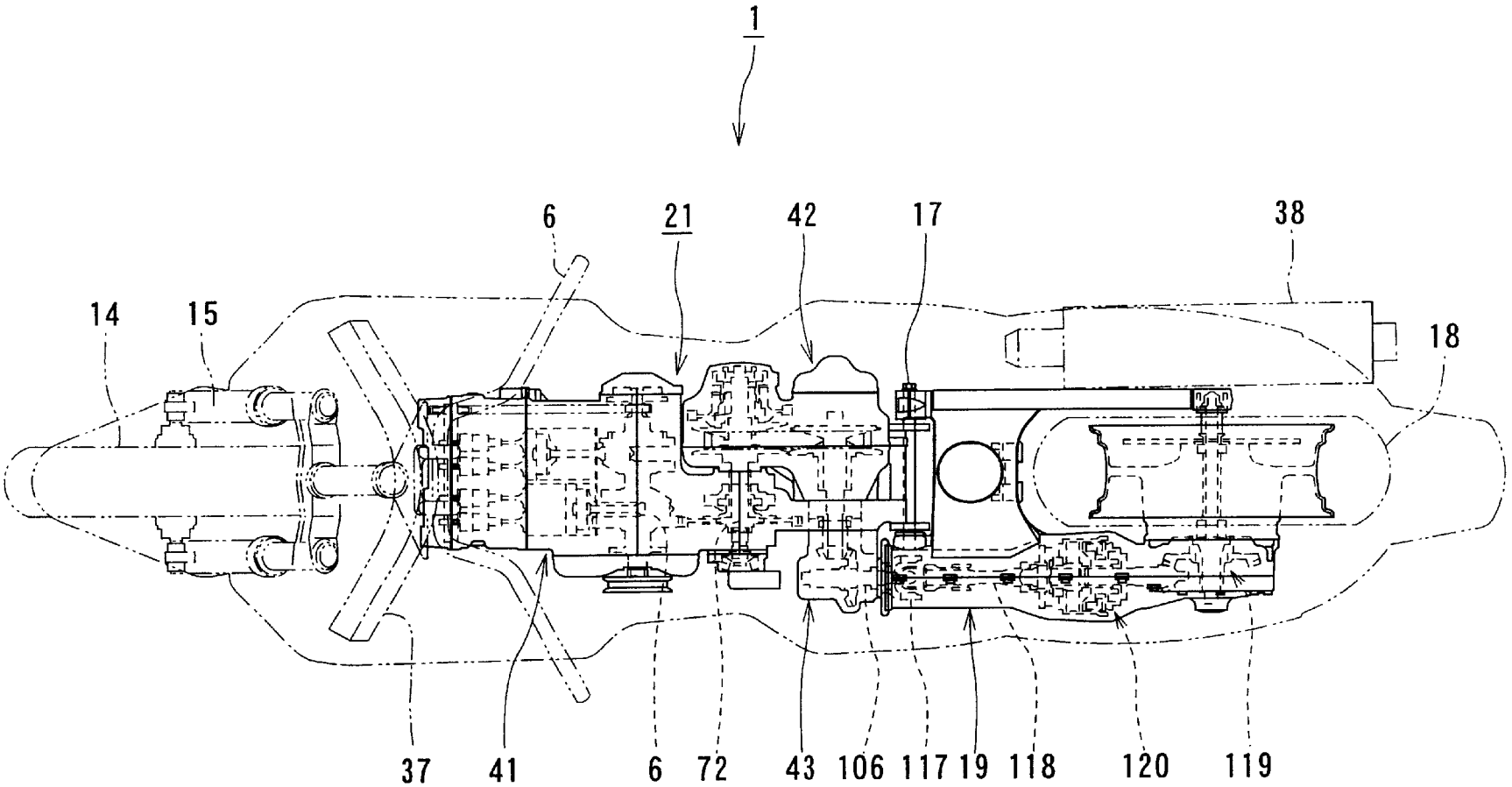
FIG. 3 is a plan view of the motorcycle.

With reference to FIGS. 1 to 3, a motorcycle 1 is provided with a body frame 2 made of a steel pipe. The body frame 2 is provided with a head pipe 3 positioned at a front end thereof, a pair of right and left down pipes 4, upper pipes 5 and middle pipes 6 extending rearward from the head pipe 3, a rear pipe 7 and a rear stay 8 connected to a portion near a rear end of the down pipe 4, a pair of right and left seat pipes 9, and a pair of right and left pivot plates 10 positioned in a substantially central portion of a vehicle (motorcycle) body so as to provide a substantially underbone type structure. In this case, a pair of right and left pipe members (4, 5, 6) are connected by a plurality of bridge pipes 11, 12 - - - extending in a direction of vehicle width therebetween.

A front fork 15 supporting a front wheel 14 is pivoted to the head pipe 3 together with a handle bar 16 or the like, a pivot shaft 17 is provided between the right and left pivot plates 10 and a swing transmission unit 19 supporting a rear wheel 18 is pivoted to the pivot shaft 17 so as to be suspended by a suspension mechanism 20 to thereby absorb a swing motion or like. Further, an engine power unit 21 is suspended and supported by the down pipe 4, the middle pipe 6 and the pivot plate 10, and a power is transmitted to the rear wheel 18 through the swing transmission unit 19.

An interval between the right and left middle pipes 6 is made narrower than an interval between the down pipes 4. The middle pipes 6 pass above the power unit 21 and the down pipes 4 pass along both side portions of the power unit 21. Further, a seat hinge 25 is provided at an upper end of a seat stay 24 extending upward from the bridge pipe 11 provided near a bent point of the middle pipe 6, and a front end of a seat 26 is supported to the seat hinge 25. The seat 26 opens and closes around the seat hinge 25, and a fuel tank 27 and an article accommodation space (article accommodation box) 30 capable of storing articles such as helmets 28 and 29 and the like are arranged below the seat 26.

A whole of the vehicle body is covered by a front cowling 32 and a frame cover 33 made of a synthetic resin, so that internal devices can be protected as well as an outer appearance of the motorcycle 1 is redesigned. Further, a pair of right and left step boards 34 (refer to FIG. 1) positioned above the down pipe 4 are integrally formed to the frame cover 33, the middle pipes 6 and the power unit 21 are received within a central console 35 formed therebetween, and an upper space of the central console 35 forms a foot straddling space 36 used at a time when a rider rides on the seat 26.

In this case, a radiator 37 for cooling an engine unit 41 is provided to a down pipe 4 so as to be positioned immediately at the rear portion of the front wheel 14, and an exhaust muffler 38 connected to a cylinder head 46 of the engine unit 41 is provided on a right side of the rear wheel 18.

As shown in FIGS. 4 to 7, the power unit 21 is a composite body in which the engine unit 41 according to the present invention, a transmission unit 42 and a bevel unit 43 are combined.

A casing 44 of the engine unit 41 has a structure in which a head cover 45, a cylinder head 46, a cylinder block 47, a crankcase 48 and a rear case 49 are combined from a forward portion of the engine unit 41 in this order, a vertical-plate-shaped bracket portion 51 extending rearward is integrally formed to a rear portion of the rear case 49, and a fitting hole 52 extending through in a direction of vehicle width is pierced in the bracket portion 51.

Figure 4:
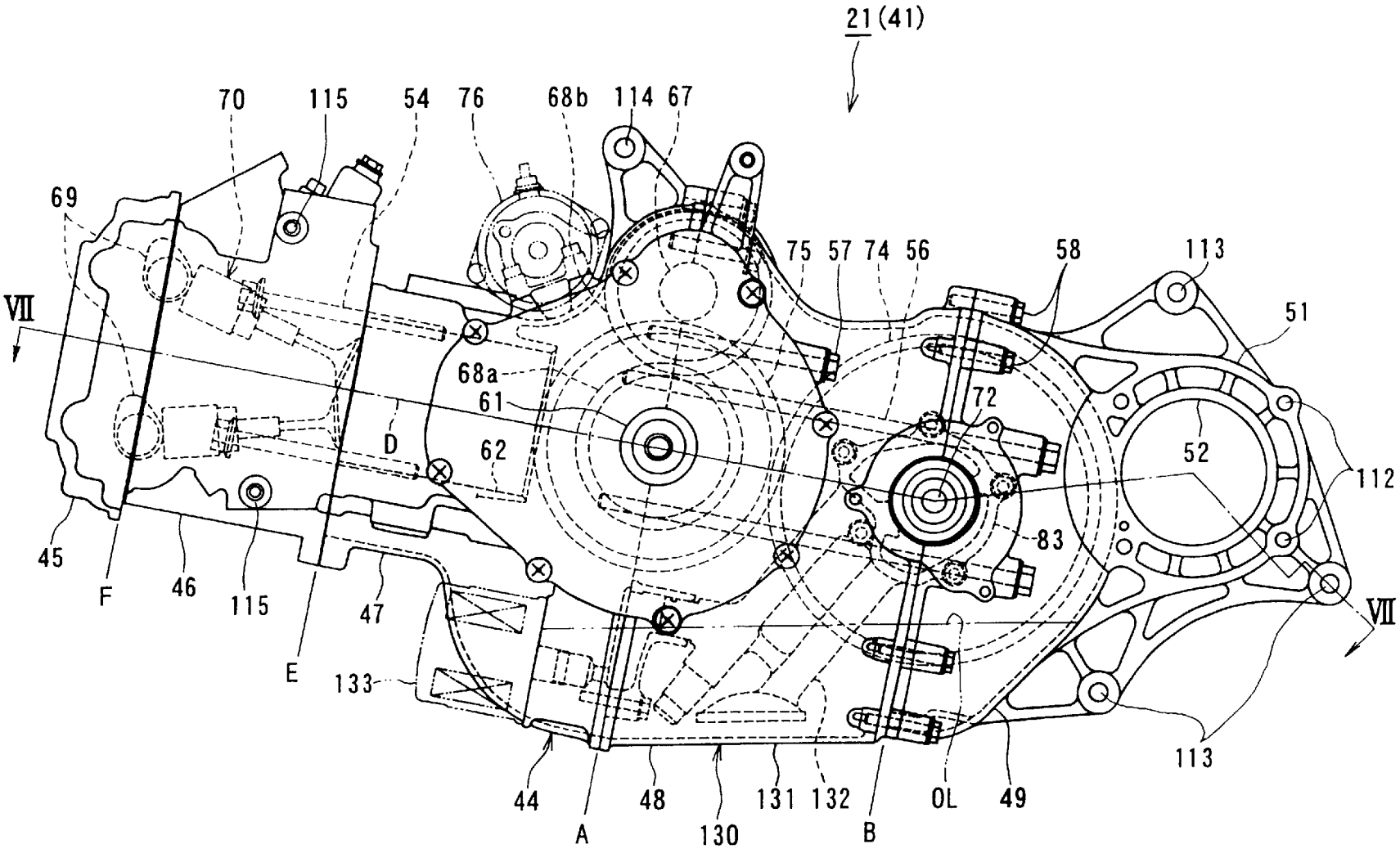
FIG. 4 is a left side view of the power unit (engine unit) showing an embodiment of the present invention.
Figure 5:
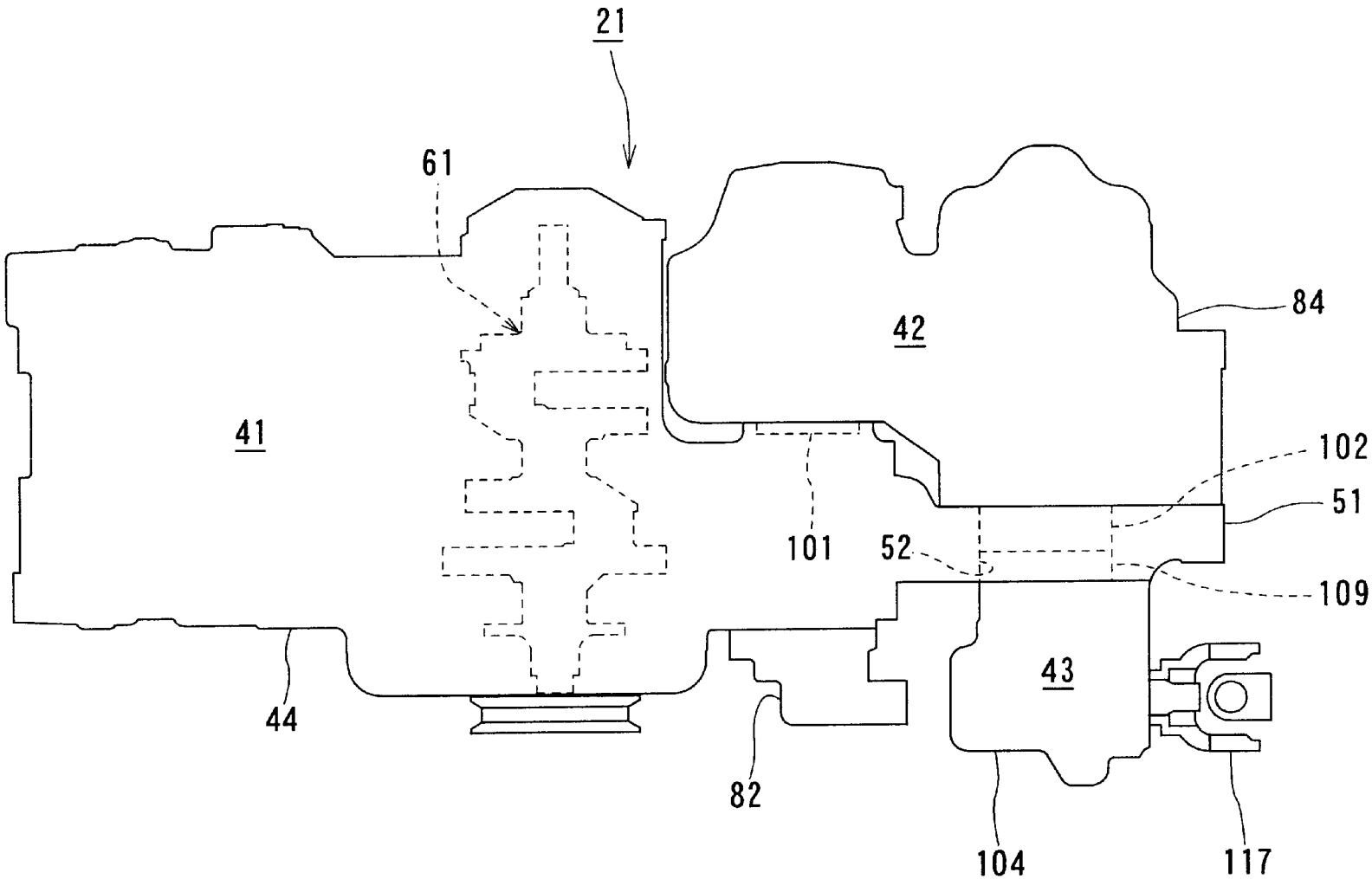
FIG. 5 is a schematic plan view of the power unit.
Figure 6:
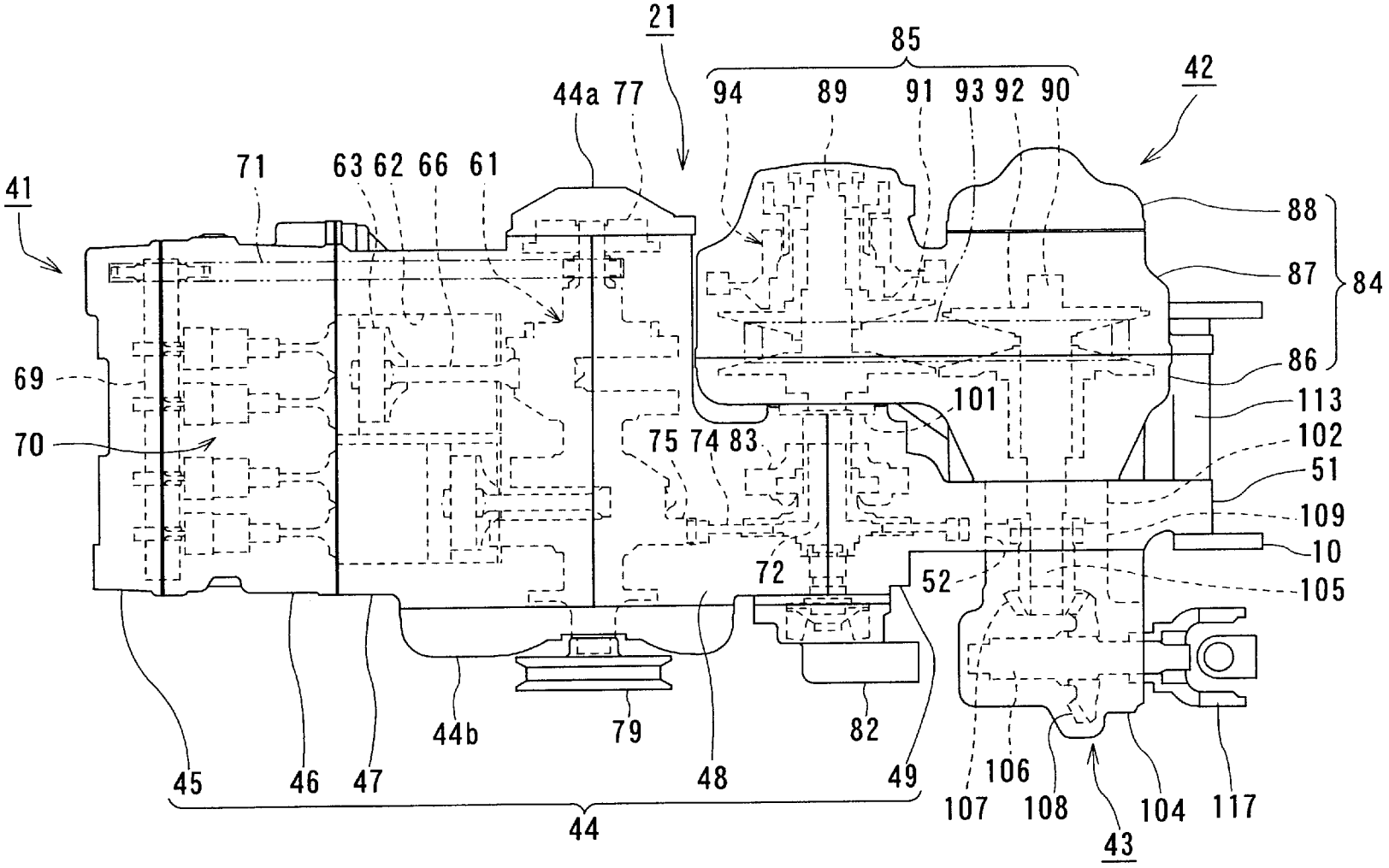
FIG. 6 is a plan view of the power unit.
Figure 7:
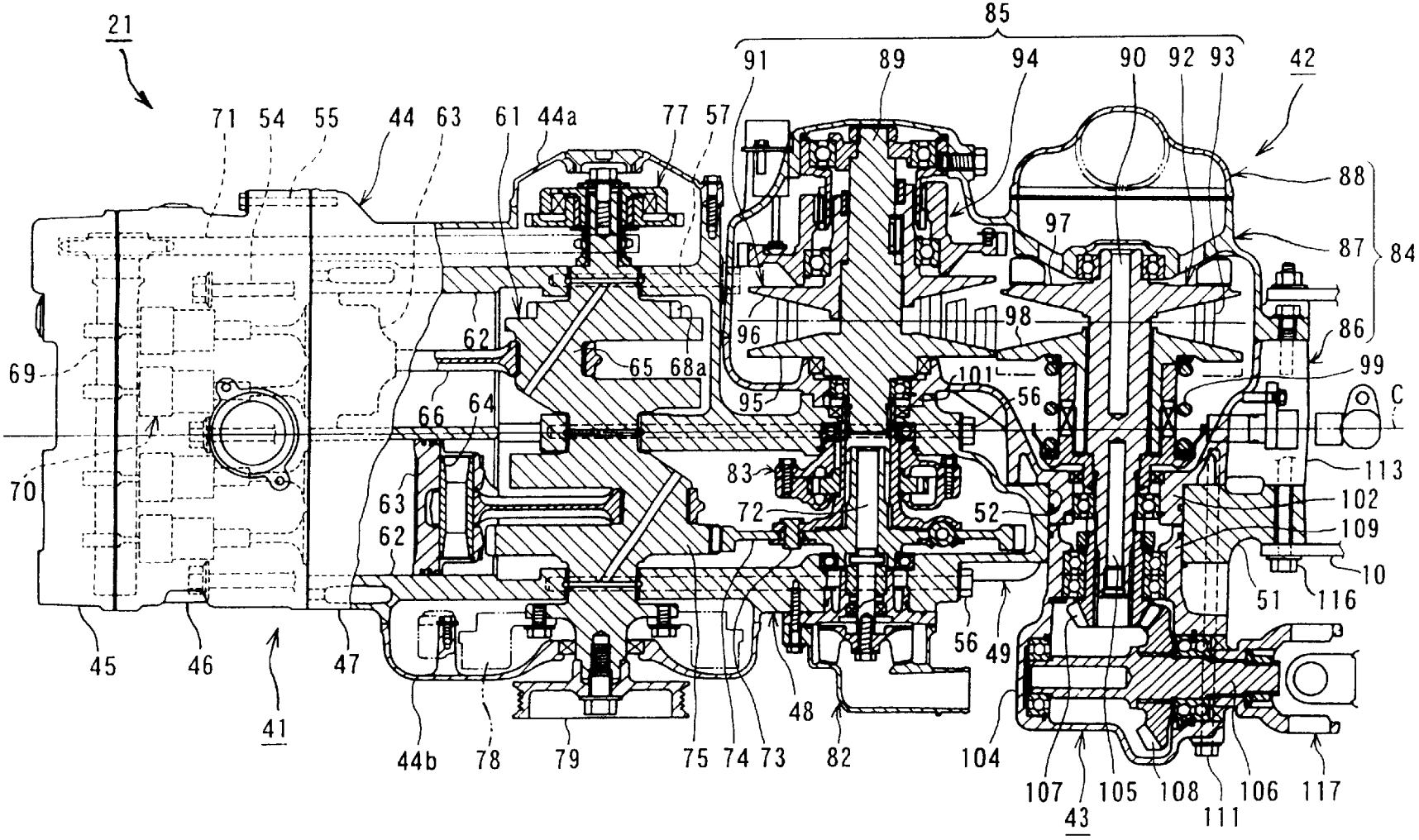
FIG. 7 is a horizontal sectional view of the power unit taken along a line VII—VII in FIG. 4.

As shown in FIGS. 4 and 7, the cylinder head 46 is fastened and fixed to the cylinder block 47 by six long fixing bolts 54 and one short fixing bolt 55, and the crankcase 48 and the rear case 49 are fastened and fixed to the cylinder block 47 by four through bolts 56 and a plurality of fixing bolts 57.

The through bolt 56 mentioned above corresponds to the "fastening member" described in the appended claim and is inserted from the side of the rear case 49 through the rear case 49 and the crankcase 48 so as to be fastened to the cylinder block 47. Accordingly, the rear case 49 and the crankcase 48 are fastened to the cylinder block 47 together by means of the through bolt 56. In this case, the fixing bolt 57 is shorter than the through bolt 56 and is inserted only to the crankcase 48 so as to be fastened to the cylinder block 47. Further, a periphery of the rear case 49 is fastened and fixed to the crankcase 48 by a plurality of short fixing bolts 58.

As mentioned above, since the crankcase 48 and the rear case 49 are fastened to the cylinder block 47 together by the common fastening member (i.e., through bolt 56), it is possible to reduce the number of the fastening members, which considerably contributes a cost reduction and improves an assembling performance. Further, since the long through bolts 56 extend through the whole of the crankcase 48 to be fastened to the cylinder block 47, it is possible to significantly increase a mounting rigidity of the crankcase 48 with respect to the cylinder block 47, thus improving a support rigidity of a crankshaft 61 mentioned next and a counter shaft 72 described later.

The crankshaft 61 disposed along the direction of vehicle width is pivoted to a mating face A (refer to FIG. 4) between the cylinder block 47 and the crankcase 48, and two right and left cylinder bores 62 are formed within the cylinder block 47. The cylinder bore 62 is provided so that a center axis D thereof is disposed substantially along a longitudinal direction of the vehicle body in a side view of the vehicle and inclined slightly front upward. Accordingly, the head cover 45 and the cylinder head 46 are also inclined slightly front upward. Therefore, a ground clearance below the cylinder head 46 becomes large (high) and a layout in an extending portion of an exhaust muffler 38 (refer to FIG. 2) can be improved.

A piston 63 is inserted in the cylinder bore 62, a piston pin 64 thereof and a crank pin 65 of the crankshaft 61 are connected by means of connecting rod 66 therebetween, and a sliding motion of the piston 63 within the cylinder bore 62 is converted into a rotational motion of the crankshaft 61 so as to generate an output power of the engine unit 41. In this case, a balancer shaft 67 for canceling an engine vibration is pivoted to a portion above the crankshaft 61. However, this balancer shaft 67 is also pivoted to the mating face A and is driven by the crankshaft 61 through uniform gears 68*a* and 68*b*.

Further, two camshafts 69 and a valve moving mechansim 70 are received in an inner portion of the cylinder head 46. Each of the cam shafts 69 is driven by the crankshaft 61 through a timing chain 71 and operates the valve system 70 at a predetermined timing so as to promote an intake and exhaust operation in the cylinder bore 62 (i.e., combustion chamber).

On the other hand, a counter shaft 72 parallel to the crankshaft 61 is pivoted to a mating face B between the crankcase 48 and the rear case 49. An axial length of the counter shaft 72 is considerably shorter than that of the crankshaft 61, the rear portion of the crankcase 48 corresponding to a receiving portion of the counter shaft 72 and the rear case 49 in a plan view (refer to FIG. 7) are arranged in a manner offset close to one side (for example, close to a left side) with respect to a center line C of the vehicle body, and a plan shape of the engine unit 41 is formed in a substantially L-shape together with the bracket portion 51 positioned at the rear thereof.

Furthermore, since a counter driven gear 74 pivoted to a left end side of the counter shaft 72 through an absorbing mechanism 73 is engaged with a counter drive gear 75 formed to a crank web at a left end portion of the crankshaft 61, the counter shaft 72 is rotated backward while being rotated with the forward rotating crankshaft 61 in an interlocking manner. Thus, a shock or the like generated together with a rotational torque change of the crankshaft 61 can be absorbed by the absorbing mechanism 73.

In this case, a right end portion of the crankshaft 61 is covered by a case cover 44*a*, and a one-way clutch mechanism 77 receiving a power from a starter motor 76 for starting the engine is provided on the inner side thereof.

On the contrary, a left end portion of the crankshaft 61 is covered by a case cover 44*b*. A flywheel 78 and a belt pulley 79 are disposed respectively inside and outside the left end portion of the crankshaft 61 so as to be integrally rotated together with the crankshaft 61, and an alternator 80 (refer to FIG. 2) for generating a power is driven by the belt pulley 79 through a belt 81. The alternator 80 is placed above the power unit 21.

Furthermore, a water pump 82 for circulating a cooling water is provided at a left end portion of the counter shaft 72 and a left side portion of the rear case 49, an oil pump 83 for supplying an engine oil is provided at a right end portion of the counter shaft 72 and an inner portion of the rear case 49, and these pumps 82 and 83 are directly driven to the counter shaft 72.

In this case, in the engine unit 41 structured in the manner mentioned above, as shown in FIGS. 4 and 7, the mating face A between the cylinder block 47 and the crankcase 48 and the mating face B between the crankcase 48 and the rear case 49 are set so that face directions thereof are in parallel to each other and substantially vertical to the center axis D of the cylinder bore 62. In this embodiment, an angle between the mating face A and the center axis D and an angle between the mating face B and the center axis D are set to constitute a right angle (90 degrees).

Accordingly, in the crankcase 48, the flattening working on the side of the mating face A and the flattening working on the side of the mating face B can be continuously executed to be easily, and the accuracy in parallelism between both the mating faces A and B can be improved. Further, in the cylinder block 47, since the flattening working on the side of the mating face A and the drilling working of the cylinder bore 62 can be continuously executed, the workings can be also easily executed, and it is possible to significantly improve a rectangular (vertical) accuracy of the center axis D of the cylinder bore 62 with respect to the mating face A. Accordingly, both the manufacturing cost reduction of the engine unit 41 and the improvement in performance can be realized.

Moreover, in the described embodiment, since a mating face E between the cylinder head 46 and the cylinder block 47 and a mating face F between the head cover 45 and the cylinder head 46 are in parallel to the mating faces A and B, respectively, it is possible for the cylinder block 47 to continuously execute the flattening working on the side of the mating face E after the flattening working on the side of the mating face A, and it is also possible for the cylinder head 46 to continuously execute the flattening working on the side of the mating face F after the flattening working on the side of the mating face E. Accordingly, it becomes easy to execute the flattening working of each of the mating faces E and F, and in addition, the accuracy in parallelism between each of the mating faces E and F and the mating face A (B) can be significantly improved.

On the contrary, four through bolts 56 fastening and fixing the rear case 49 and the crankcase 48 to the cylinder block 47 and two fixing bolts 57 disposed near the right cylinder bore 62 are arranged near the crankshaft 61 and the counter shaft 72 so that the center axes thereof are in parallel to the center axis D of the cylinder bore 62, and these six bolts 56 and 57 are arranged so as to surround the periphery of two cylinder bores 62 and hold the crankshaft 61 and the counter shaft 72 between the upper and lower sides thereof.

In the described embodiment, center axes of the other fixing bolts 57 fastening and fixing the crankcase 48 to the cylinder block 47, a plurality of fixing bolts 58 fastening and fixing the rear case 49 to the crankcase 48 and the like are all in parallel to the center axis D of the cylinder bore 62.

When the center axes of the through bolts 56 and the fixing bolts 57 are made parallel to the center axis D of the cylinder bore 62 as mentioned above, it is possible to work the through holes for the through bolts 56 and the fixing bolts 57 at the same time of drilling the cylinder bore 62 in the cylinder block 47. It becomes therefore significantly easy to work the cylinder block 47.

Furthermore, since the through bolts 56 and the fixing bolts 57 are arranged near the crankshaft 61 and the counter shaft 72 so as to hold both the shafts 61 and 72 between the upper and lower sides thereof, it is possible to improve the support rigidity of the crankshaft 61 and the counter shaft 72.

Here, as shown in FIG. 4, a lower portion of a rear half portion of the cylinder block 47 and lower portions of the crankcase 48 and the rear case 49 are descended (lowered) below a lower surface of the cylinder head 46 and a front half portion of the cylinder block 47, this descended portion is formed as an oil storage portion 130 and an oil is stored therein at a height of an oil level OL. A bottom 131 of the oil storage portion 130 is formed to be flat and a surface direction of the bottom 131 is set to be substantially parallel to the road surface while the center axis D of the cylinder bore 62 is inclined slightly front upward.

Furthermore, while an oil strainer 132 extending to a front oblique downward direction from the oil pump 83 reaches near the bottom 131 of the oil storage portion 130, an oil filter 133 is placed in a front surface of the oil storage portion 130, below the cylinder bore 62 in a side view of the motorcycle and above the bottom 131 of the oil storage portion 130, which is replaceable. By placing the oil filter 133 to this position, it becomes possible to improve an attaching and detaching performance of the oil filter 133 and prevent the oil spilling down at a time of attaching and detaching the oil filter from soiling a portion around the engine unit 41.

When the engine unit 41 is operated, the oil pump is driven by the counter shaft 72, the oil is sucked from the oil strainer 132, and the sucked oil is supplied to each of lubricating portions in the engine unit 41 after being filtered by the oil filter 133 and returned again to the oil storage portion 130. In the described embodiment, since the center axis D of the cylinder bore 62 is inclined slightly front upward, the oil supplied in the cylinder head 46 can be easily returned to the oil storage portion 130.

As mentioned above, the oil storage portion 130 is integrally provided below the cylinder block 47, the crankcase 48 and the rear case 49, it is possible to omit the oil pan conventionally provided as the independent part. It is hence possible to reduce the number of the parts and it becomes unnecessary to form the oil pan mating face in each of the members 47, 48 and 49, so that it becomes very easy to manufacture. Further, since the bottom of the oil storage portion 130 is substantially in parallel to the road surface while the center axis D of the cylinder bore 62 is inclined slightly front upward, the oil storage amount can be increased and the oil filter 133 can be placed to a position with an improved attaching and detaching operability.

On the contrary, the transmission unit 42 has a belt type transmission (for example, CVT) 85 placed in a casing 84 apart from the engine unit 41. The casing 84 is formed as a three-piece structure comprising an inner case 86 positioned on an inner side in a direction of the vehicle width, an outer case 87 attached to an outer side thereof in a liquid tight sealing manner and a case cover 88 attached to an outer side thereof.

The belt type transmission 85 is provided with an input shaft 89 and an output shaft 90 pivoted to a front portion and a rear portion in the casing 84 in parallel to the crankshaft 61. The transmission 85 is also provided with an input V-pulley 91 and an output V-pulley 92 respectively pivoted to the shafts 89 and 90 so as to be integrally rotated, a V-belt (or a metal belt) 93 wound between both the V-pulleys 91 and 92, and a facing drive mechanism 94 coaxially provided with the input V-pulley 91.

The input V-pulley 91 has a fixed facing 95 integrally formed with the input shaft 89 and a movable facing 96 provided so as to be freely movable in an axial direction, and a position of the movable facing 96 is determined by the facing drive mechanism 94. Further, the output V-pulley 92 also has a fixed facing 97 and a movable facing 98. The movable facing 98 is always pressed to a side of the fixed facing 97 by a spring 99.

The input V-pulley 91 is arranged close to the left end of the input shaft 89, the output V-pulley 92 is arranged close to the right end of the output shaft 90, the input V-pulley 91 and the output V-pulley 92 are arranged in a manner so as to be aligned in a longitudinal direction, the facing drive mechanism 94 is arranged on a right side of the input V-pulley 91, and a blower of the case cover 88 is provided on the rear side of the facing drive mechanism 94 and on the right side of the output V-pulley 92.

As mentioned above, the input V-pulley 91 and the output V-pulley 92 of the transmission unit are lined up longitudinally, and the facing drive mechanism 94 and the blower are also lined up longitudinally and the output shaft 90 is arranged so as to protrude inside in the direction of the vehicle width from the output V-pulley 92. Accordingly, a plan shape of the transmission unit 42 is formed in a substantially L-shape.

Further, a bearing boss 101 provided on a front left side surface of the transmission unit 42 (i.e., inner case 86) is closely fitted and fixed to the right side surface of a connecting portion between the crankcase 48 and the rear case 49 of the engine unit 41. The input shaft 89 of the transmission unit extending through the bearing boss 101 and the counter shaft 72 of the engine unit 41 are connected through a spline connection or the like so as to be integrally rotated.

On the contrary, the rear left side surface of the transmission unit 42 (86) is arranged in adjacent to the right side surface (side of the center line C of the vehicle body) of the bracket portion 51 in the engine unit 41, and a bearing boss 102 of the output shaft 90 is closely fitted to the fitting hole 52 of the bracket 51.

As mentioned above, the engine unit 41 and the transmission unit 42 according to the present invention are formed in a substantially L-shape in a plan view. However, both the substantially L-shaped portions are combined with each other so as to provide a substantially rectangular shape.

On the other hand, the bevel unit 43 has a bevel input shaft 105 extending along the direction of the vehicle width and a bevel output shaft 106 extending along the direction of the vehicle length, which are pivoted to an inner portion of an independent casing 104. Further, an input bevel gear 107 and an output bevel gear 108 engaged with the input bevel gear 107 are respectively provided to the bevel input shaft 105 and the bevel output shaft 106 so as to be integrally rotated.

Then, the bevel unit 43 is arranged on the left side surface (on the side opposite to the center line C of the vehicle body) of the bracket portion 51 in the engine unit 41 so as to be adjacent to the bracket portion 51, a bearing boss 109 of the bevel input shaft 105 is closely fitted and fixed to the fitting hole 52 of the bracket portion 51, and the output shaft 90 and the bevel input shaft 105 are connected through the spline connection or the like so as to be integrally rotated.

As shown in FIG. 7, a fastening member such as a through bolt 111 or the like is fastened to the transmission unit 42 from the left side thereof through the bevel unit 43 and the bracket portion 51, and the bevel unit 43 and the bracket portion 51 are fastened to the transmission unit 42 together by means of through bolt 111. In this case, totally four through bolts 111 are used, and each of the through bolts 111 extends through a through hole 112 formed around the fitting hole 52 of the bracket 51 at an equal interval as shown in FIG. 4.

In this case, for example, three frame fixing portions 113 are provided around the bracket portion 51, and these frame fixing portions 113, one frame fixing portion 114 provided in the cylinder block 47 as shown in FIG. 4 and two frame fixing portions 115 provided in the cylinder head 46 are respectively fastened to fastening portions provided to the down pipes 4, the middle pipes 6 and the pivot plate 10 in the body frame 2 by means of fixing bolts 116 (refer to FIG. 7). Accordingly, the power unit 21 is fixed entirely to the body frame 2.

In the power unit 21 structured in the manner mentioned above, the rotation of the crankshaft 61 of the engine unit 41 is transmitted to the counter shaft 72, the input shaft 89 of the transmission unit 42 and the input V-pulley 91 thereof, and the rotation of the input V-pulley 91 is transmitted to the output V-pulley 92 and the output shaft 90 through the V-belt 93. Further, the rotation of the output shaft 90 is transmitted to the bevel output shaft 106 via the bevel input shaft 105, and the input bevel gear 107 and the output bevel gear 108 in the bevel unit 43. An output of the engine is taken out rearward from the bevel output shaft 106.

Furthermore, in this embodiment, since the tooth number of the counter drive gear 75 is smaller than the tooth number of the counter driven gear 74, the rotational speed of the crankshaft 61 is primarily reduced when being transmitted to the counter shaft 72. Further, since the tooth number of the input bevel gear 107 is smaller than the tooth number of the output bevel gear 108, a secondary speed reduction is performed here.

Then, a rotation of the bevel output shaft 106 is transmitted to a drive shaft 118 pivoted to the swing transmission unit 19 through a universal joint 117 (refer to FIGS. 3, 5 and 6), and a rotation of the drive shaft 118 is transmitted to the rear wheel 18 through a rear bevel gear mechanism 119. In this embodiment, for example, an electromagnetic clutch 120 is provided in a middle portion of the drive shaft 118, and the power of the engine unit 41 is interrupted with respect to the rear wheel 18 in response to an ON and OFF operation of the clutch 120.

Furthermore, the facing drive mechanism 94 of the belt type transmission 85 in the transmission unit 42 moves the movable facing 96 of the input V-pulley 91 in an axial direction in accordance with various conditions such as a running speed, a throttle angle, an engine load or the like of the motorcycle 1, on the basis of a power of an actuator controlled by control means, not shown.

For example, at a time when the motorcycle 1 starts, the facing drive mechanism 94 moves the movable facing 96 apart from the fixed facing 95 so as to make minimum an effective diameter of the input V-pulley 91 for winding the belt. In addition, since on the output V-pulley 92 side, the movable facing 98 is pressed against the side of the fixed facing 97 due to the urging force of the spring 99 and the effective diameter for winding the belt becomes maximum, a gear ratio becomes high and it is hence possible for the engine to easily start.

Further, during the acceleration of the motorcycle 1, the facing drive mechanism 94 gradually moves the movable facing 96 of the input V-pulley 91 close to the side of the fixed facing 95 so as to increase the effective diameter of the input V-pulley 91 for winding the belt. Then, on the output V-pulley 92 side, since the movable facing 98 moves apart from the fixed facing 97 against the urging force of the spring 99, and the effective diameter for winding the belt is reduced, the change gear ratio becomes low and a vehicle speed is thus increased.

Moreover, since the engine unit 41, the transmission unit 42 and the bevel unit 43, which are independently provided and formed in a sealed manner, are integrally combined, the respective units 41, 42 and 43 can be manufactured at different production sites and a significantly high productivity can be ensured.

Furthermore, in the case of changing the specification such as the engine output, the gear ratio or the like or maintaining a specific portion, only one of three units 41, 42 and 43 may be disassembled or replaced, so that the maintenance can be more easily performed, and this may be easily applicable to other types of vehicles.

In addition, since the bearing boss 102 of the variable change unit 42 and the bearing boss 109 of the bevel unit 43 are coaxially fitted and fixed to the fitting holes 52 of the bracket portion 51 in the engine unit 41, it becomes unnecessary to work and form a plurality of fitting portions and fixing portions, so that it is possible to improve a working accuracy and reduce a working labor and process, and it is also possible to increase an assembling rigidity of whole the power unit 21.

Further, since the engine unit 41 and the transmission unit 42 which are formed in a substantially L-shape in a plan view are combined with each other so as to be formed in the substantially rectangular shape in a plan view, no dead space is generated between the engine unit 41 and the transmission unit 42.

Still furthermore, since the transmission unit 42 is arranged on the side of the center line C of the vehicle body (the right side) of the bracket 51 offset close to one side (in this case, close to the left side) with respect to the center line C of the vehicle body, and the bevel unit 43 having a lateral width smaller than that of the transmission unit 42 is arranged in the side opposite to the center line C of the vehicle body (the left side) of the bracket portion 51, any one of the transmission unit 42 and the bevel unit 43 does not protrude sideward more largely than the lateral width of the engine unit 41. Accordingly, it is possible to make compact the sizes of the power unit 21 in the longitudinal direction and the width direction.

Still furthermore, in the power unit 21 of the structure described above, since the bracket portion 51, the transmission unit 42 and the bevel unit 43 in the engine unit 41 are fastened together by the through bolts 111 disposed along the direction of the vehicle width, it is possible to reduce the number of the fastening members (through bolts 111) and simultaneously reduce the assembling labor and number of processes so as to largely increase a productivity of the power unit 21, in comparison with the case that the transmission unit 42 and the bevel unit 43 are respectively fastened to the bracket portion 51 by using exclusive fastening members.

On the contrary, since the frame fixing portion 113 for fixing the power unit 21 to the body frame 2 is provided in the bracket portion 51 of the engine unit 41, the connecting portion (that is, the bracket portion 51) of three units 41, 42 and 43 constituting the power unit 21 is firmly fixed to the body frame 2, whereby it is possible to increase a supporting rigidity of the whole of the power unit 21 to the body frame 2.

It is to be noted that the present invention is not limited to the described embodiment and many other changes and modifications may be made without departing from the scope of the appended claims.

For example, the structure of the power unit 21 is not limited to the scooter type motorcycle and may be also applicable to an engine unit for the other types of motorcycles or the other kinds of vehicles.

What is claimed is:

1. An engine unit of a motorcycle comprising a cylinder head, a cylinder block formed with a cylinder bore therein, a crankcase and a rear case sequentially assembled in this order from a front side of a motorcycle body, wherein a crankshaft is pivoted to a mating face between the cylinder block and the crankcase, a counter shaft which is rotated with said crankshaft in an interlocking manner is pivoted to a mating face between the crankcase and the rear case and said two mating faces lie in planes parallel to each other so as to be substantially perpendicular to a center axis of the cylinder bore of the cylinder block.

2. An engine unit of a motorcycle according to claim 1, wherein said cylinder block is fastened by a fastening member inserted from a side of said rear case so as to extend through the crankcase to thereby commonly fasten said rear case and said crankcase to said cylinder block in a clamping manner.

3. An engine unit of a motorcycle according to claim 2, wherein said fastening member has a center axis parallel to the center axis of said cylinder bore.

4. An engine unit of a motorcycle according to claim 2, wherein said fastening member includes a plurality of through bolts which are arranged in a vicinity of the crankshaft and the counter shaft so as to clamp the crankshaft and the counter shaft therebetween.

5. An engine unit of a motorcycle according to claim 4, wherein said cylinder head is fastened and fixed to the cylinder block by a plurality of long fixing bolts and a single short fixing bolt, and said crankcase and said rear case are fastened and fixed to the cylinder block by the four though bolts and a plurality of fixing bolts.

6. An engine unit of a motorcycle according to claim 5, wherein all said fixing bolts have center axes substantially parallel to the center axis of the cylinder bore.

7. An engine unit of a motorcycle according to claim 1, wherein the center axis of said cylinder bore is arranged so as to extend substantially along a longitudinal direction of the motorcycle body in a side view thereof and at least one of said cylinder block, crankcase and rear case has a lower portion lowered below a lower surface of the cylinder head so as to provide an inner portion of the lowered portion as an oil storage portion.

8. An engine unit of a motorcycle according to claim 7, wherein the center axis of said cylinder bore has an front upward inclination in a side view of the motorcycle body and said oil storage portion has a bottom formed to be flat substantially in parallel to a road surface.

9. An engine unit of a motorcycle according to claim 8, wherein said oil storage portion has a front portion to which an oil filter is placed below the cylinder bore in a side view of the motorcycle body and above the bottom of the oil storage portion.

* * * * *